US006456723B1

(12) United States Patent
Bank et al.

(10) Patent No.: US 6,456,723 B1
(45) Date of Patent: Sep. 24, 2002

(54) ACOUSTIC DEVICE

(75) Inventors: Graham Bank, Suffolk; Neil Harris, Cambridge, both of (GB)

(73) Assignee: New Transducers Limited, London (GB)

( * ) Notice: Subject to any disclaimer, the term of this patent is extended or adjusted under 35 U.S.C. 154(b) by 9 days.

(21) Appl. No.: 09/589,752

(22) Filed: Jun. 9, 2000

Related U.S. Application Data

(60) Provisional application No. 60/150,805, filed on Aug. 26, 1999.

(30) Foreign Application Priority Data

Jun. 10, 1999 (GB) ..... 9913465

(51) Int. Cl.[7] ..... H04R 25/00
(52) U.S. Cl. ..... 381/425; 381/152
(58) Field of Search ..... 381/152, 423, 381/431, 190, 424, 425; 181/150, 167, 170

(56) References Cited

U.S. PATENT DOCUMENTS 3,347,335 A * 10/1967 Watters et al. ..... 381/152
6,058,196 A * 5/2000 Heron ..... 381/152

FOREIGN PATENT DOCUMENTS

WO WO 97/09842 3/1997
WO WO 99/41939 8/1999

* cited by examiner

*Primary Examiner*—Sinh Tran
(74) *Attorney, Agent, or Firm*—Foley & Lardner

(57) ABSTRACT

An acoustic device has a plurality of resonant bending wave modes along the length of a member. The fundamental frequency of resonant bending wave modes in directions perpendicular to the length is much higher, so that the lower frequency resonant bending wave modes are substantially one directional. A plurality of transducers may be spaced across the width of the member at a preferred position along the length of the panel.

27 Claims, 2 Drawing Sheets

Variation in SPL around "modal" direction.

Variation in SPL around "non-modal direction.

ACOUSTIC DEVICE

This application claims the benefit of provisional application No. 60/150,805, filed Aug. 26, 1999.

FIELD OF THE INVENTION

The invention relates to an acoustic device, and in particular to an acoustic device of the type that uses resonant bending wave modes.

BACKGROUND

Prior resonant bending wave devices are described in WO97/09842 and U.S. counterpart application Ser. No. 08/707,012, filed Sep. 3, 1996 (now U.S. Pat. No. 6,332,029) (the latter application being incorporated herein by reference in its entirety). These documents describe a panel having resonant bending wave modes in the area of the panel. A transducer may be provided at a preferential location on the panel for exciting the resonant modes. Such a device is known as a distributed mode loudspeaker. Operated in reverse, the device is a distributed mode microphone.

U.S. Pat. No. 3,347,335 describes a loudspeaker in which bending waves are sent along a beam. In this device the bending waves are excited at one end of the beam and a nonreflecting termination is provided at the other end. Since the termination is non-reflecting, the bending waves will travel down the beam, be absorbed and will not reflect back to form resonant modes.

SUMMARY OF THE INVENTION

According to the invention there is provided an acoustic device comprising a member having a modal axis along which axis there are a plurality of resonant bending wave modes, and non-modal axes perpendicular to the modal axis, wherein the fundamental frequency of the resonant modes along each non-modal axis is at least five times the fundamental frequency of the resonant modes along the modal axis.

Preferably, the fundamental frequency of the resonant modes along each non-modal axis is at least ten times the fundamental frequency along the modal axis. The higher the fundamental frequency along the non-modal axis compared to along the modal axis, the more the acoustic device can be said to be "one-dimensional".

The member may be a panel with the modal axis along the length of the panel and a non-modal axis along the width of the panel. The panel need not be flat.

When a resonant bending wave mode is excited in a panel it will cause the panel to displace by a small amount out of the plane of the panel. The amount of this displacement will vary along a direction in the plane of the panel, and it is the direction along which the displacement varies and not the direction of the displacement itself that is meant when a bending wave mode is said to be along a particular direction.

The fundamental frequency along a particular axis is the frequency of the lowest bending wave mode along that axis. The density of modes along an axis is related to the fundamental frequency along that axis: in a broad frequency range there will be more resonant modes along an axis with a low fundamental frequency than along an axis with a higher fundamental frequency.

For comparison, the prior art documents WO97/09842 and U.S. Ser. No. 08/707,012 teach interleaving the frequencies of the modes along the long and short axes, which requires similar fundamental frequencies. That document teaches isotropic panels with aspect ratios of 1.134 or 1.41, which correspond to ratios of fundamental frequencies of 1.285 and 2 respectively.

The fundamental frequency $f_o$ along an axis of a panel may be related to the panel bending stiffness B (about a perpendicular axis) and the panel length L along the axis by the proportional relationship (which assumes constant mass per unit area)

$$(f_o)^2 \alpha B/L^4.$$

It will be seen that in order to achieve a high ratio of the fundamental frequency along the width axis over that along the length axis the width may be less than half, preferably less than a third of the length.

The sound emitted from a panel is anisotropic at frequencies where resonant bending wave modes along the modal axis, but not the non-modal axis, are excited. In such frequency ranges sound is preferentially emitted into a plane perpendicular to the panel through the modal axis, and reduced in a plane perpendicular to the modal axis through the non-modal axis. This can give rise to enhancement of the sound into the plane through the modal axis at these frequencies. Accordingly the panel may be particularly suitable for use with piezoelectric transducers, which have a frequency response which tails off at low frequencies. The increased low frequency sound output can compensate for this tailing off of excitation to provide a more even sound overall.

The preferential sound radiation into a single plane can also be useful in some specific applications, for example to direct sound into a horizontal plane in a room and avoid sending too much sound to a ceiling or floor of the room.

The preferential emission of sound into a plane is greatest for a flat panel, rather than a rod, and increases with increased width. However, this assumes that the one-dimensionality can be maintained and that modes along the non-modal axis of the panel are not excited. This latter condition requires a narrow width. In order to achieve the contradictory requirements of one-dimensional behaviour but with a panel of significant width a highly anisotropic panel may be used.

The panel may be stiffer to bend about the modal axis than about the non-modal axis. The bending stiffness of the panel about the modal axis panel may be at least 1.5 times that about the non-modal axis, further preferably at least twice as stiff. Since the resonant bending wave modes along an axis cause bending about a perpendicular axis, if the panel is stiffer to bend about the modal axis this will reduce the number of modes along the non-modal axis.

A panel having anisotropic bending stiffness may be made of a material having a corrugated or cellular structure, with the cells or corrugations running in the plane of the panel along the non-modal axis.

In embodiments, a transducer may be provided to excite the resonant bending wave modes. The transducer may preferably be placed at a location which is spaced away from the nodes of the lower modes along the modal direction. To achieve this, the transducer may be placed at a preferred location along the length of the member, for example at substantially 4/9, 3/7 or 5/13 of the length along the modal axis. These locations are similar to those taught in WO97/09842 and U.S. Ser. No. 08/707,012, except that in those documents the preferred locations have these coordinate values in both directions. The transducer need not be placed on the modal axis, but may be placed laterally thereof.

A plurality of transducers may be provided. To provide multiple transducers at one preferred location a plurality of transducers may be placed side by side across the width of the panel. This can provide increased output. Alternatively, a single transducer may extend across the width of the panel at a preferred location. Such a transducer can be effective even if it only causes bending along one axis.

A bending transducer extending across the width of the panel may be able to provide greater power than a single point-like transducer for use on a two-dimensional panel which cannot have a significant spatial extent.

It may also be possible to excite the panel at a less-preferred location, for example a location nearer one end than the preferred location. It is possible to vary the bending stiffness along the modal axis so that positions other than those mentioned above become preferred. Alternatively, it may be possible to damp or clamp the panel in some way to improve the efficiency of the panel even when excited at a less preferred location.

BRIEF DESCRIPTION OF THE DRAWING

For a better understanding of the invention a specific embodiment will now be described, purely by way of example, with reference to the accompanying drawing, in which.

DETAILED DESCRIPTION

Figure 1:
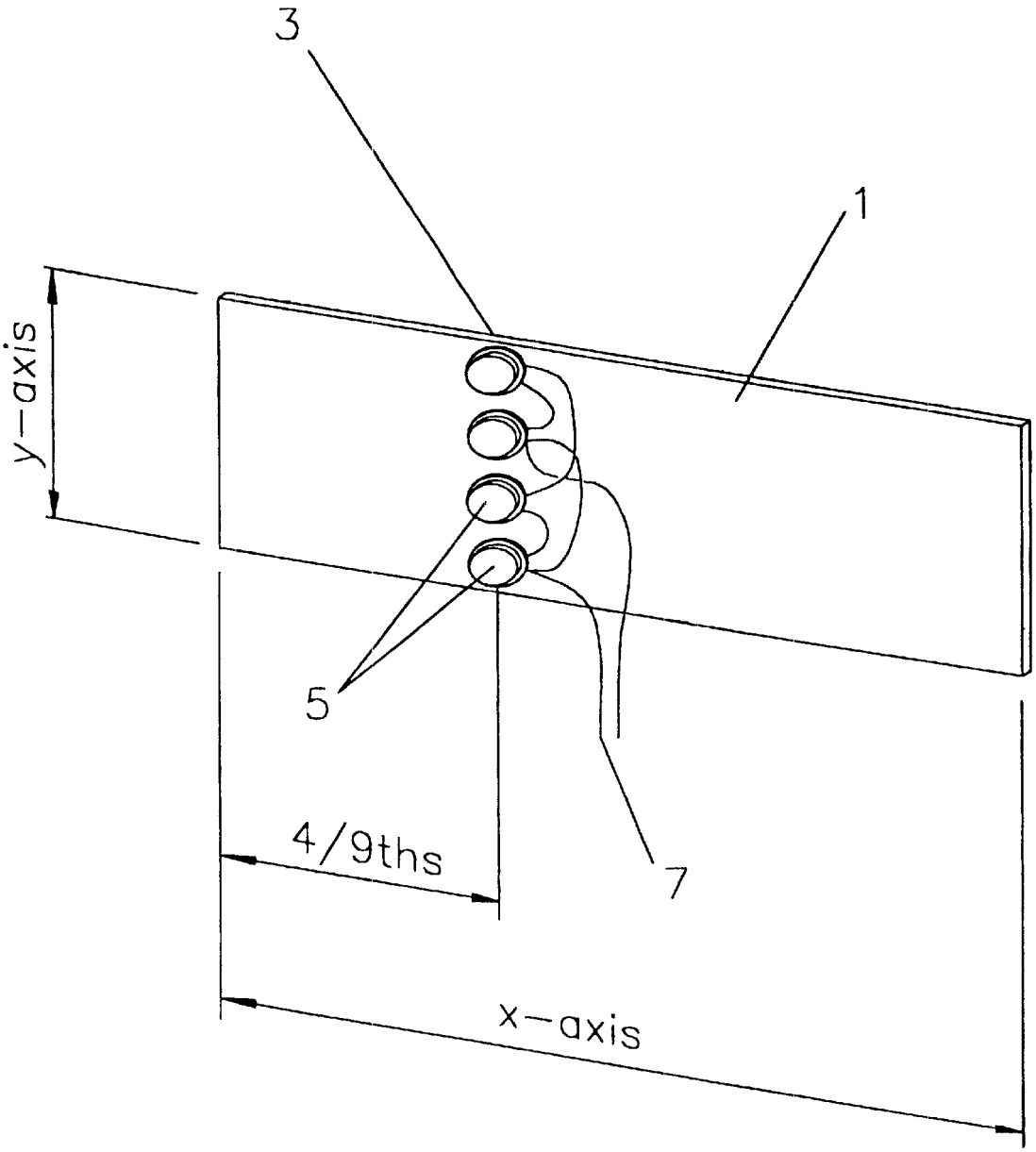
FIG. 1 shows an acoustic device according to the present invention.

Referring to FIG. 1, a rectangular panel 1 is substantially flat extending in the x (length) and y (width) directions as shown. The panel is anisotropic in bending stiffness and is much narrower than it is long. It is also much stiffer about the x axis than the y axis. Accordingly, the fundamental frequency is much lower along the x axis, the modal axis, than along the non-modal y-axis. Therefore, there are many more resonant bending wave modes along the x axis than along the y axis.

A plurality of transducers 5 are arranged spaced apart from one another in the y direction along a line 3 extending across the width of the panel. The line 3 is spaced from one end of the panel along the length of the panel at a distance of four ninths of the length of the panel in the x direction. The plurality of transducers can input more power into the panel than would be possible with a single transducer. There are fewer constraints in applying multiple transducers in the present apparatus than there are in applying multiple transducers to a distributed mode panel according to WO97/09842 and U.S. Ser. No. 08/707,012, since in such two-dimensional panels the transducer position is constrained to a preferred location whereas in essentially one-dimensional panels the location is constrained merely to be a preferred distance along the length of the panel.

The transducers 5 are connected to a conventional amplifier by leads 7; they are conventional bending wave transducers. They can be piezoelectric transducers.

Figure 2:
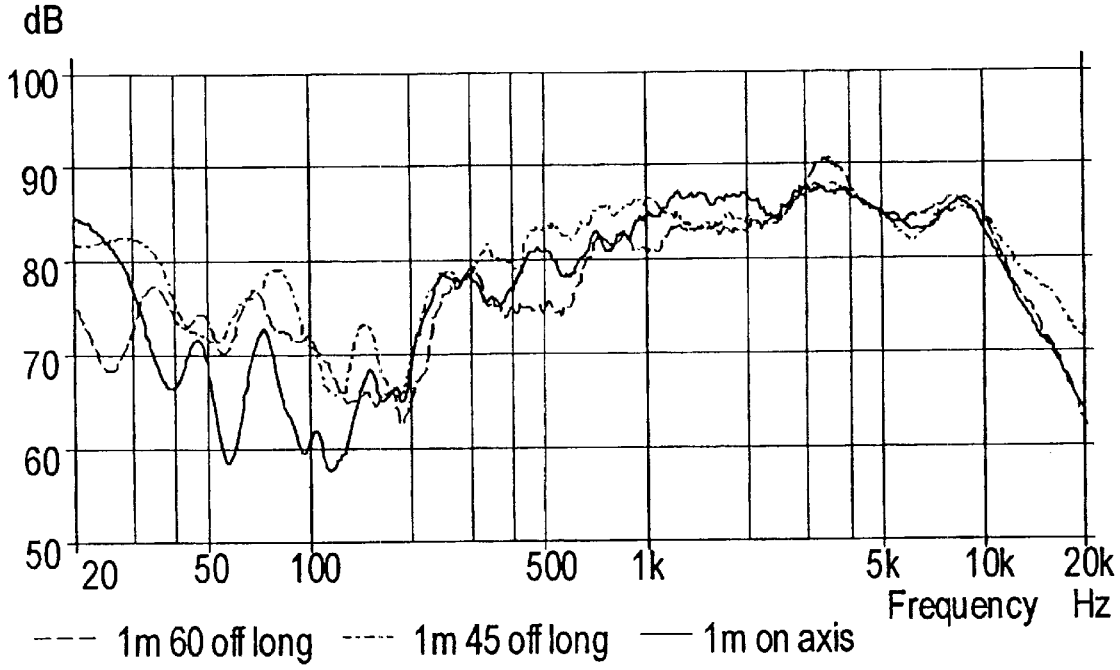
FIG. 2 shows the output of the panel shown in FIG. 1 as a function of frequency at three directions in a plane perpendicular to the panel and along the modal direction.
Figure 3:
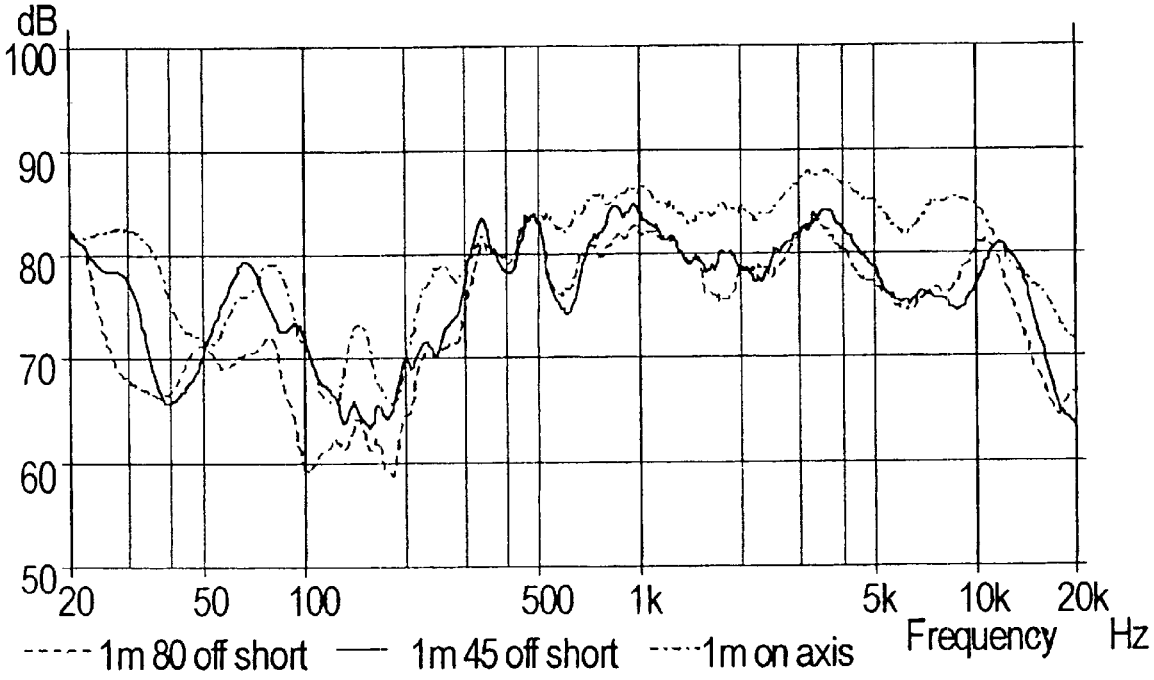
FIG. 3 shows the output of the panel shown in FIG. 1 as a function of frequency at three directions in a plane perpendicular to the panel and along the non-modal direction.

The sound pressure level in dB produced by such a panel has been measured as a function of frequency. FIG. 2 shows the sound pressure level "on axis", i.e. perpendicular to the plane of the panel, and at two further directions offset by 45° and 60° from that axis towards the x direction. FIG. 3 shows the sound pressure level "on axis", i.e. perpendicular to the plane of the panel, and at two further directions offset by 45° and 80° from that axis towards the y direction. Thus FIG. 3 shows sound pressure levels emitted sideways and FIG. 2 shows sound pressure levels emitted along the length of the panel. The sound pressure levels are measured at a distance of 1m from the panel.

The panel measured is made from a corrugated polymer sold under the trade mark "Correx". It is about 2.83 times stiffer about the modal axis than about the non-modal axis.

The sound energy is not very directional in the plane of the modal axis (see FIG. 2). The high frequencies are radiated to a very wide angle, and the mid frequencies are only slightly reduced off axis. This curve is similar to the curve obtained from a classic distributed mode panel as taught, for example, by WO97/09842 and U.S. Ser. No. 08/707,012.

In contrast, in the plane of the non-modal axis the sound pressure level is strongly reduced away from the axis at high frequencies, and maintained at mid frequencies(see FIG. 3). The measurements show that little sound is emitted sideways.

In order to increase the effect, the width of the panel can be increased. When the panel is wide, the wavefronts become cylindrical and the low frequency output rises at 3 dB per octave as the frequency is lowered. This can compensate for a falling output from a piezoelectric driver at these frequency ranges. However, as can be seen from the relation presented above there are limits to the width of the panel in order that the fundamental frequencies remain different enough for effective one-dimensional behaviour.

What is claimed is:

1. An acoustic device for operation in a predetermined frequency range comprising a member having a modal axis, and a non-modal axis orthogonal to the modal axis, wherein the member can support a plurality of resonant bending wave modes in the predetermined frequency range along the modal axis, and the fundamental frequency of resonant bending wave modes along the non-modal axis is at least five times the fundamental frequency of the resonant bending wave modes along the modal axis, whereby the sound emitted from the member is anisotropic at frequencies where resonant bending wave modes along the modal axis, but not the non-modal axis, are excited.

2. An acoustic divice according to claim 1, wherein the fundamental frequency of the resonant modes along the non modal axis is at least ten times the fundamental frequency along the modal axis.

3. An acoustic device according to claim 2, wherein the member is in the form of a panel having a length and a width wherein the modal axis is along the length of the panel and the non-modal axis along the width of the panel.

4. An acoustic device according to claim 3, wherein the width of the panel is less, than half the length of the panel.

5. An acoustic device according to claim 3, wherein the bending stiffness of the panel about the modal axis is at least 1.5 times the bending stiffness of the panel about the non-modal axis.

6. An acoustic device according to claim 5, wherein the panel has a corrugated or cellular structure, with the corrugations or cells running along the non-modal axis.

7. An acoustic device according to claim 5, wherein the bending stiffness of the panel about the modal axis is about 2.83 times the bending stiffness of the panel about the non-modal axis.

8. An acoustic device according to claim 1, wherein the number is in the form of a panel having a length and a width wherein the modal axis is along the length of the panel and the non-modal axis along the width of the panel.

9. An acoustic device according to claim 8, wherein the width of the panel is less than half the length of the panel.

10. An acoustic device according to claim 8, wherein the bending stiffness of the panel about the modal axis is at least 1.5 times the bending stiffness of the panel about the non-modal axis.

11. An acoustic device according to claim 10, wherein the panel has a corrugated or cellular structure, with the corrugations or cells running along the non-modal axis.

12. An acoustic device according to claim 1, further comprising a transducer coupled to the member for exciting the resonant bending wave modes.

13. An acoustic device according to claim 12, wherein the transducer is placed at a location spaced away from the nodes of a predetermined plurality of lower frequency resonant bending wave modes.

14. An acoustic device according to claim 13, wherein the transducer is placed at or laterally of a position substantially 4/9, 3/7 or 5/13 along the modal axis of the member from either end of the member.

15. An acoustic device according to claim 12, wherein the transducer is a piezoelectric transducer.

16. An acoustic device according to claim 12, comprising a plurality of transducers.

17. An acoustic device according to claim 16, wherein the transducers arranged across the width of the panel.

18. An aroustic device according to claim 12, wherein the transducer substantially spans the width of the member.

19. An acoustic device for operation in a predetermined frequency range comprising:

a member in the form of a panel having a length and a width, the panel having a modal axis along the length of the panel and a non-modal axis along the width of the panel, and a transducer coupled to the panel for exciting the resonant bending wave modes, wherein the panel can support a plurality of resonant bending wave modes in the predetermined frequency range along the modal axis, and the fundamental frequency of resonant bending wave modes along the non-modal axis is at least five times the fundamental frequency of the resonant bending wave modes along the modal axis, whereby the sound emitted from the member is anisotropic at frequencies where resonant bending wave modes along the modal axis, but not the non-modal axis, are excited.

20. An acoustic device according to claim 19, wherein the bending stiffness of the panel about the modal axis is at least 1.5 times the bending stiffness of the panel about the non-modal axis.

21. An acoustic device according to claim 20, wherein the transducer is placed at a location spaced away from the nodes of a predetermined plurality of lower frequency resonant bending wave modes.

22. An acoustic device according to claim 21, wherein the transducer is placed at or laterally of a position substantially 4/9, 3/7 or 5/13 along the modal axis of the member from either end of the member.

23. An acoustic device according to claim 20, wherein the transducer is a piezoelectric transducer.

24. An acoustic device according to claim 20, comprising a plurality of transducers.

25. An acoustic device according to claim 24, wherein the transducers arranged across the width of the panel.

26. An acoustic device according to claim 20, wherein the transducer substantially spans the width of the member.

27. An acoustic device according to claim 20, wherein the bending stiffness of the panel about the modal axis is about 2.83 times the bending stiffness of the panel about the non-modal axis.

* * * * *